US007927115B2

(12) United States Patent
Sun

(10) Patent No.: US 7,927,115 B2
(45) Date of Patent: Apr. 19, 2011

(54) SIM CARD CONNECTOR WITH SWITCH ELEMENT

(75) Inventor: Liang Sun, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/612,705

(22) Filed: Nov. 5, 2009

(65) Prior Publication Data

US 2010/0112839 A1 May 6, 2010

(30) Foreign Application Priority Data

Nov. 5, 2008 (CN) ..... 2008 1 0234167

(51) Int. Cl.
*H01R 29/00* (2006.01)

(52) U.S. Cl. ..... 439/159; 439/188

(58) Field of Classification Search ..... 439/159, 439/188, 489

See application file for complete search history.

(56) References Cited

U.S. PATENT DOCUMENTS

| | | | | |
|---|---|---|---|---|
| 7,261,578 | B2 * | 8/2007 | Zhao | 439/188 |
| 7,473,115 | B2 * | 1/2009 | Yu et al. | 439/188 |
| 2008/0026619 | A1 * | 1/2008 | Chang | 439/159 |

* cited by examiner

*Primary Examiner* — Gary F. Paumen

(74) *Attorney, Agent, or Firm* — Wei Te Chung; Andrew C. Cheng; Ming Chieh Chang

(57) ABSTRACT

A card connector (100) includes an insulative housing (1), a number of signal terminals (2) received in the insulative housing, an ejector (3) assembled to a side of the insulative housing, a first switch terminal (5), a second switch terminal (6) and a third switch terminal (7). The insulative housing defines a card receiving room. The first switch terminal is urged by the ejector and slidable together with the ejector. The second switch terminal and the third switch terminal each include a first contacting pad (61, 71) extending planar with respect to the insulative housing and parallel with each other. The first and second contacting pads establishing an electrical connection through the first switch terminal in response to a slidable movement of the ejector.

20 Claims, 6 Drawing Sheets

SIM CARD CONNECTOR WITH SWITCH ELEMENT

BACKGROUND OF THE INVENTION

1. Field of the Invention

The present invention relates generally to a SIM card connector, and more particularly to a SIM card connector having a durable switch element suitable for repeated use without failure.

2. Description of Related Arts

A card connector, such as a SIM card connector used in a mobile phone, is electrically connected with an inserted SIM card for signal transmission therebetween. A switch element is usually assembled in the SIM card connector for detecting whether the SIM card is fully inserted or not. U.S. Pat. No. 7,261,578, issued to Zhao on Aug. 28, 2007 and entitled "CARD CONNECTOR", discloses a card connector including an insulating housing, a plurality of contacts received in the insulating housing, an ejector assembled at a side of the insulating housing and a switch detecting the card's insertion into the card connector. The insulating housing defines a receiving space and a receiving cavity communicating with the receiving space. The ejector comprises an insulating slider assembled in the receiving cavity and having an ejecting member protruding into the receiving space so as to be pushed by the card when the card is inserted into the card connector. Therefore, the slider slides in the receiving channel together with the card's insertion/ejection. The switch comprises a pair of conductive pieces and a conductive plate. Said conductive plate is fixed to the slider and is slidable together with the slider. Said conductive pieces come into contact with the conductive plate when the card urges the slider to slide to a first position, at which position the card is fully inserted and an electrical connection between the card and the card connector is achieved. At least one of the conductive pieces comes out of contact with the conductive plate when the ejector is pushed again and slides to a second position, at which position the card is urged to move away from the first position. The electrical connection between the card and the card connector is broken and a user easily pulls the card out of the card connector. However, the conductive pieces are retained in the insulating housing and have a pair of cantilevered contacting portions in a recess section of the insulating housing. When the conductive plate presses against the conductive pieces, the contact portions are pressed downwardly toward the recess section because of elasticity of the conductive pieces. However, the elasticity of the conductive pieces is weakened after repeated use. The switch thus may not work properly to detect the card's insertion again.

Hence, a SIM card connector having a durable switch element capable of withstanding repeated use is desired.

SUMMARY OF THE INVENTION

Accordingly, an object of the present invention is to provide a SIM card connector having a durable switch element.

To achieve the above object, a card connector includes an insulative housing, a number of signal terminals received in the insulative housing, an ejector assembled to a side of the insulative housing, a first switch terminal, a second switch terminal and a third switch terminal. The insulative housing defines a card receiving room. The first switch terminal is urged by the ejector and slidable together with the ejector. The second switch terminal and the third switch terminal each include a first contacting pad extending planar with respect to the insulative housing and parallel with each other. The first and second contacting pads establishing an electrical connection through the first switch terminal in response to a slidable movement of the ejector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
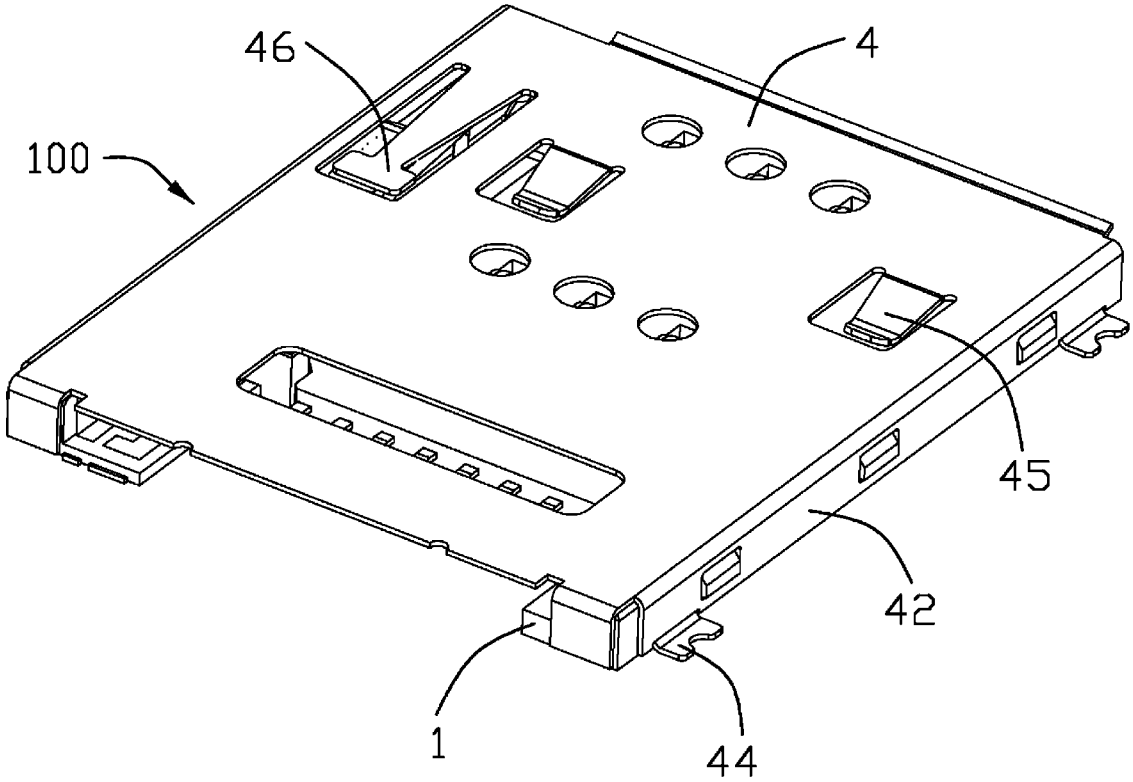
FIG. 1 is a perspective, assembled view of a card connector constructed in accordance with the present invention.
Figure 2:
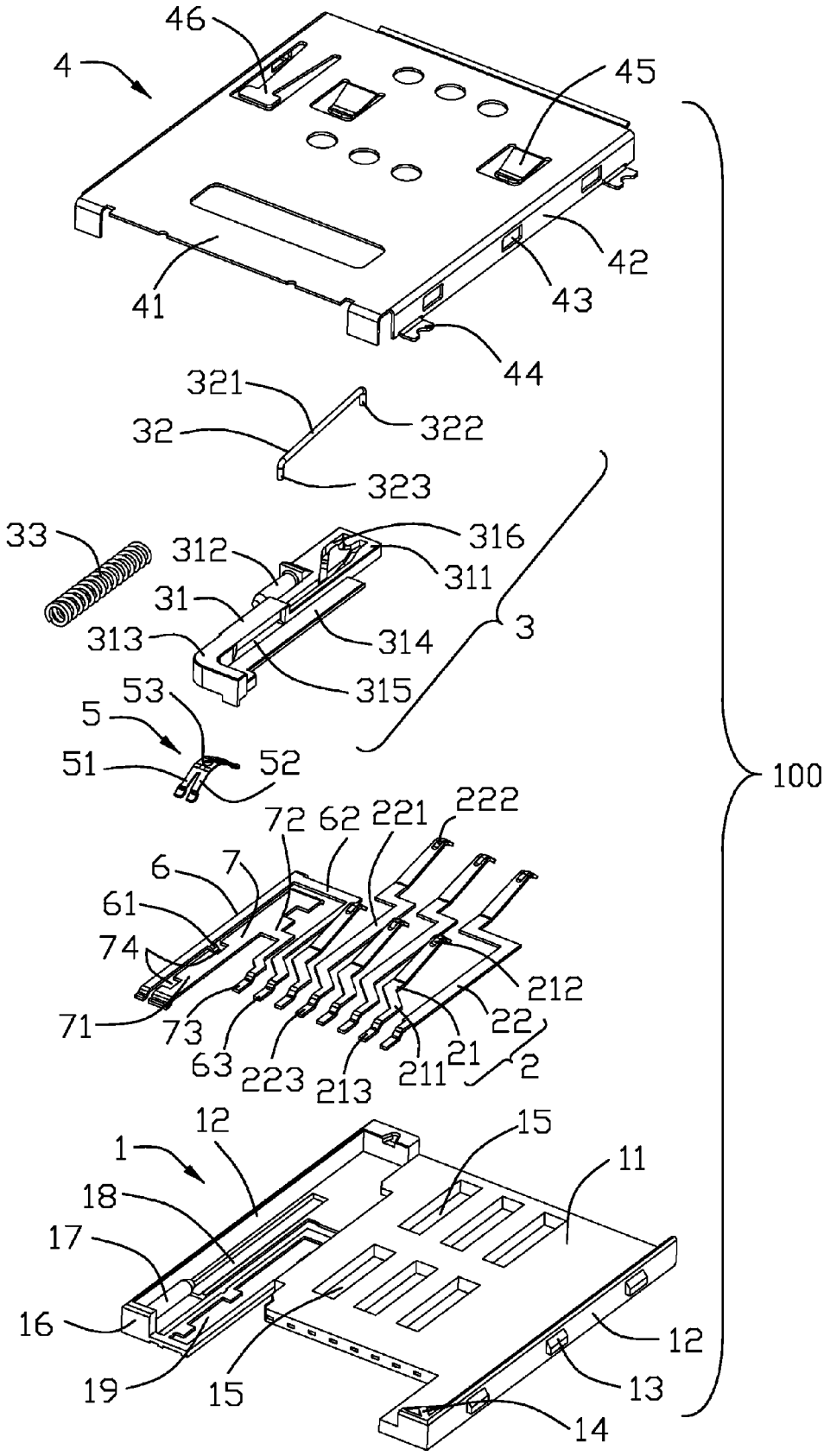
FIG. 2 is a perspective, exploded view of the card connector of FIG. 1.

Referring to FIGS. 1-2, a card connector 100 of the present invention includes an insulative housing 1, a plurality of signal terminals 2 received in the insulative housing 1, an ejector 3 assembled at a side of the insulative housing 1, a shield 4 covering the insulative housing 1 for defining a card receiving room, a first/moveable switch terminal 5 urged by the ejector 3 and slidable together with the ejector 3, a second/immoveable switch terminal 6 and a third/immoveable switch terminal 7 both insert-molded in the insulative housing 1.

Referring to FIG. 2, the insulative housing 1 is rectangular and comprises a base portion 11 and a pair of lateral walls 12 extending upwardly from the base portion 11. Each lateral wall 12 forms a plurality of protrusions 13 cooperatively interlocking with the shield 4. The insulative housing 1 forms a fool-proofing block 14 at an end of a first lateral wall 12. The base portion 11 defines a plurality of passageways 15 for receiving the signal terminals 2. The passageways 15 are arranged in two arrays and each passageway 15 extends lengthwise along a card's insertion/ejection direction. The base portion 11 defines a pair of receiving channels 19 beside the card receiving room, a receiving cavity 18 communicating with the card receiving room and positioned at an opposite side of the receiving channels 19 with respect to the card receiving room. The receiving cavity 18 and the receiving channels 19 respectively receive the ejector 3 and the switch terminals 6, 7. The insulative housing 1 further forms a front wall 16 connecting with the second lateral wall 12 and a positioning post 17 extending from the front wall 16 toward the receiving cavity 18.

Referring again to FIG. 2, the signal terminals 2 comprise a plurality of contacting portions 212, 222 mating with corresponding contacts (not shown) of an inserted card (not shown), a plurality of rear portions 213, 223 soldered to a printed circuit board (not shown) and a plurality of connecting portions 211, 221 connecting the contacting portions 212, 222 with the rear portions 213, 223. The rear portions 213, 223 extend out of the insulative housing 1 to arrange in a line and the contacting portions 212, 222 are received in the passageways 15 to be located in two arrays. The signal terminals 2 are divided into a group of first terminals 21 and a group of second terminals 22, each second terminal 22 having a length greater than that of the first terminal 21. The first terminals 21 and the second terminals 22 are alternately located. Each second terminal 22 is laterally located at the corresponding first terminal 21 and the contacting portion 222 of the second terminal 22 bends laterally, diagonally to a front of the contacting portion 212 of the first terminal 21 along the card ejection direction.

Referring still to FIG. 2, the first switch terminal 5 is of a metal piece and comprises a first arm 51, a second arm 52 and a connecting arm 53 connecting with the first and second arms 51, 52. The first switch terminal 5 is approximately H-shaped in a plane view. The first arm 51 and the second arm 52 of the first switch terminal 5 are both arc shaped and each have two free ends with a distance therebetween. The connecting arm 53 connects with the first arm 51 and the second arm 52 in a middle part thereof. The connecting arm 53 defines a hole (not labeled) for mounting to the ejector 3. The second switch terminal 6 and the third switch terminal 7 are both U-shaped, each comprising a contacting pad 61, 71, a connecting pad 62, 72 and a soldering pad 63, 73 extending along a same side as the contacting pad 61, 71 with respect to the connecting pad 62, 72. The contacting pads 61, 71 of the second switch terminal 6 and the third switch terminal 7 are embedded in the receiving channels 19 without buldging out from the insulative housing 1, while the soldering pads 63, 73 extend out of the insulative housing 1 like the rear portions 213, 223 of the signal terminals 2 and are arranged in the same line as the rear portions 213, 223. In detail, the "U" shape of the second switch terminal 6 is larger than that of the third switch terminal 7 and accordingly, the second switch terminal 6 surrounds the third switch terminal 7. The third switch terminal 7 defines a pair of cutouts 74 on the contacting pad 71 with openings towards the contacting pad 61 of the first switch terminal 6 and the distance between the cutouts 74 is consistent with the distance between the two free ends of each arm 51, 52.

Referring again to FIG. 2, the shield 4 is configured like a frame and comprises a top wall 41 and a pair of vertical walls 42 extending downwardly from two opposite edges of the top wall 41. Each vertical wall 42 defines a plurality of slits 43 cooperatively interlocked with the protrusions 13 of the insulative housing 1. Each vertical wall 42 further comprises a plurality of metal ears 44 for electrically soldering with the printed circuit board. The top wall 41 is stamped to have a pair of elastic pieces 45 bending into the card receiving room for pressing against the card when the card is inserted so as to achieve a stable electrical connection between the corresponding contacts of the card and the signal terminals 2. The elastic pieces 45 have the same distance to the adjacent vertical walls 42. The top wall 41 further forms a flexible piece 46 extending into the card receiving room, with a smaller distance to the adjacent vertical wall 42 than the distance between the elastic piece 45 and the vertical wall 42.

Figure 3:
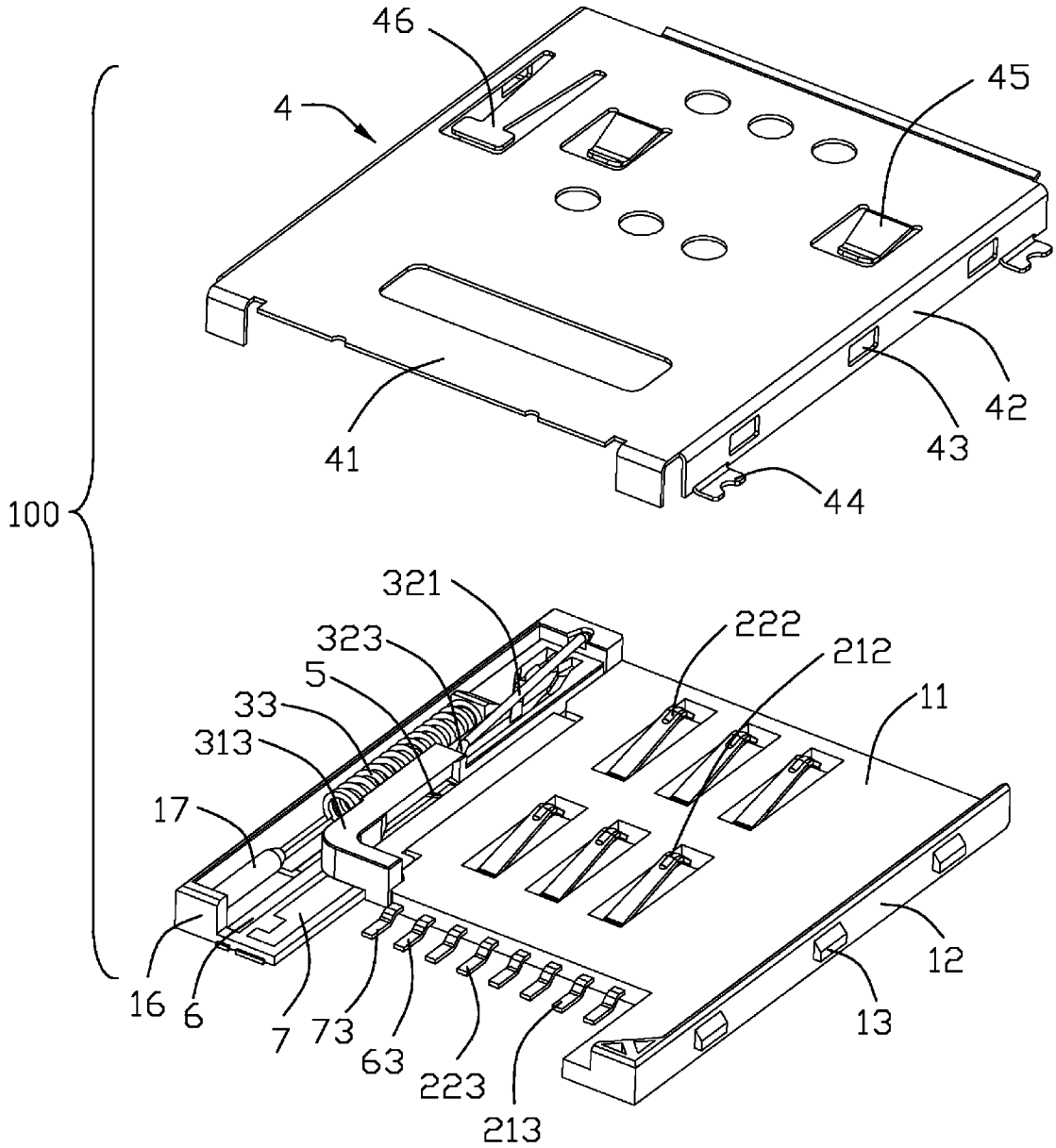
FIG. 3 is a perspective, partly exploded view of the card connector when the shield is separated from the insualtive housing.

Referring to FIGS. 2-3, the ejector 3 comprises a slider 31, a pin member 32 and a spring member 33. The slider 31 is received in the receiving cavity 18 of the insulative housing 1. The slider 31 comprises a base 311, a column 312 extending from the base 311 along an opposite direction relative to the positioning post 17 and a transverse arm 313 extending vertically from the base 311 toward the card receiving room. Because the receiving cavity 18 communicates with the card receiving room, the slider 31 is moveable in the receiving cavity 18 when the transverse arm 313 is pushed by the inserted card. The base 311 defines a heart-shaped slot 316 in an upper surface thereof and a notch 315 in a lower surface thereof. Although not shown, it can be understood that the base 311 may form a pole or like structure extending into the notch 315. The first switch terminal 5 is received in the notch 315 and the pole of the ejector 3 protrudes into the hole of the connecting arm 53 for positioning the first switch terminal 5 with respect to the slider 5. Therefore, the first switch terminal 5 is moveable together with the slider 31. The pin member 32 comprises a shaft portion 321 and a pair of pivot portions 322, 323 extending downwardly from two ends of the shaft portion 321. The pivot portion 322 is engaged with the insulative housing 1 while the pivot portion 323 is slidably received in the heart-shaped slot 316 of the slider 31. The spring member 33 is positioned by the column 312 and the positioning post 17 and can be compressed to have elasticity when the slider 31 is moved along the card's insertion direction.

Figure 4:
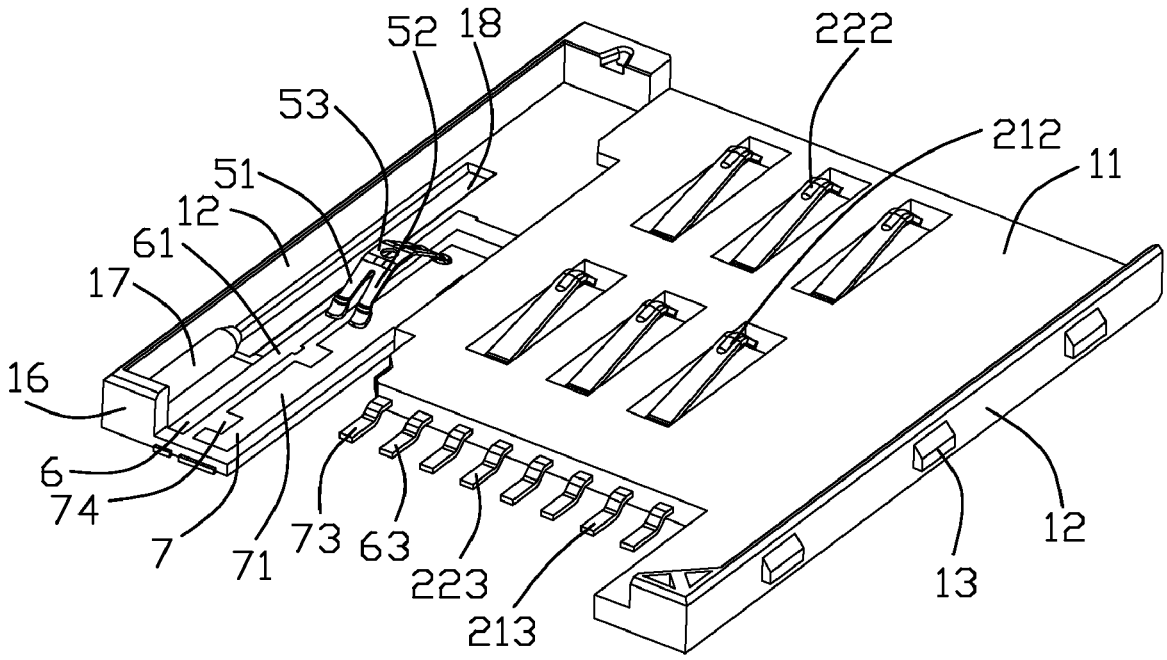
FIG. 4 is a perspective view of the card connector without the shield when the card is not inserted.
Figure 5:
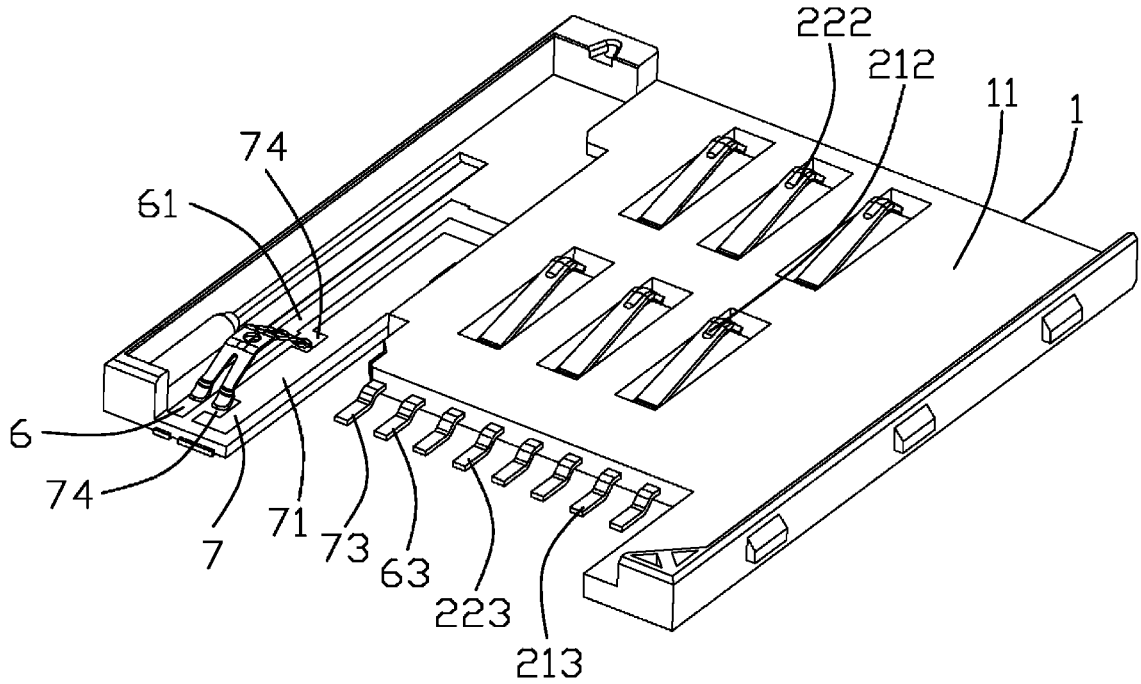
FIG. 5 is a perspective view of the card connector when the card is not fully inserted.
Figure 6:
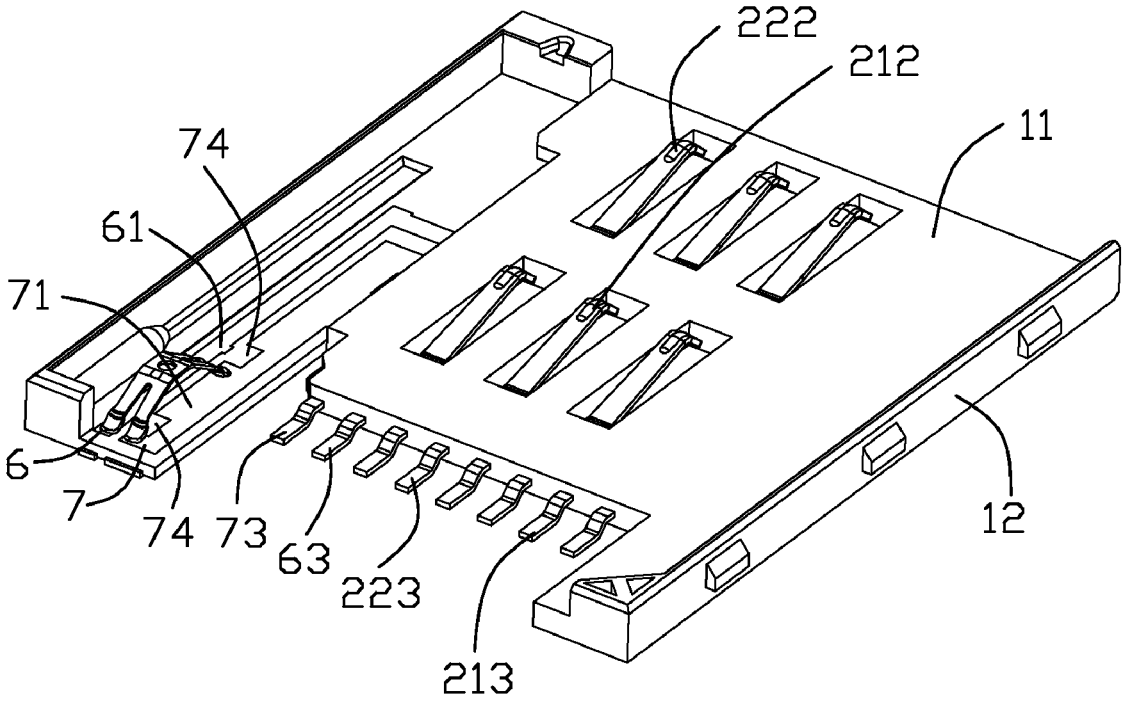
FIG. 6 is a perspective view of the card connector when the card is fully inserted.

Referring to FIGS. 4-6, when the first switch terminal 5 is received in the notch 315, the first arm 51 of the first switch terminal 5 keeps connection with the contacting pad 61 of the second switch terminal 6 during the card's insertion/ejection. Before the card is inserted, the first switch terminal 5 is in a first position at which position the second arm 52 of the first switch terminal 5 connects with the contacting pad 71 of the third switch terminal 7 and hence, the second switch terminal 6 is connected with the third switch terminal 7 by the first switch terminal 5. When the card is inserted in the card receiving room, the card presses against the transverse arm 313 of the slider 31 and drives the slider 31 to move along the card insertion direction. The movement of the slider 31 drives the first switch terminal 5 to move along the card insertion direction. The first switch terminal 5 moves to a second position when the second arm 52 meets with the cutouts 74 of the third switch terminal 7, at which position the connection between the second switch terminal 6 and the third switch terminal 7 is broken. However, the card is not fully inserted and the user still needs to push the card a little deeper to achieve the full insertion of the card. The first switch terminal 5 achieves a third position after the second arm 52 leaves the cutouts 74 of the third switch terminal 7. The connection between the second switch terminal 6 and the third switch terminal 7 is achieved again. Anyhow, due to the spring member 33 constantly urging the slider 31, the first switch terminal 5 is successively back to the second position when the pivot portion 323 rests at an inner rest/tip position of the heart-shaped slot 316. Then, card is substantially fully mated with the card connector 100 and an electrical connection between the card and the card connector 100 is achieved.

In the ejection of the card, the user needs only to push the card slightly along the card insertion direction to have the pivot portion 323 leave the inner rest/tip position so that the first switch terminal 5 moves to the third position again while successively the spring member 33 of the ejector 3 releases elasticity and drives the slider 31 to move along the card ejection direction. Thereby, the slider 31 drives the first switch terminal 5 to move away from the third position, passing the second position, and back to the first position at which the card is unlocked with the card connector 100. Thereafter, the user pulls the card out of the card connector 100 easily.

In an alternative embodiment, the first arm and the second arm of the first switch terminal each have a single free end and the connecting arm connects with the other ends of the first arm and the second arm to substantially form a "U" shape. The U-shaped first switch terminal is secured to the slider 51 of the ejector 3. Correspondingly, the third switch terminal 7 defines a single cutout 74 on the contacting pad 71 for connecting with the free end of the second arm 52. The first arm 51 of the first switch terminal 5 does not need to constantly connect with the contacting pad 61 of the second switch terminal 6 all the time. The contacting pad 61 of the second switch terminal 6 alternatively may define at least one cutout the same as that defined on the contacting pad 71 of the third switch terminal 7, and the at least two cutouts of the two switch terminals 6, 7 are symmetrical with each other to make sure that the first switch terminal 5 moves to contact with the second switch terminal 6 and the third switch terminal 7 synchronously, and meets with the at least two cutouts, at which position the first switch terminal 5 disconnects from the second switch terminal 6 and the third switch terminal 7 synchronously.

In the present invention, because the contacting pads 61, 71 of the second switch terminal 6 and the third switch terminal 7 are received in the receiving channels 19 without any part thereof cantilevered out of the insulative housing 1, the first switch terminal 5 presses against the contacting pads 61, 71 of the second switch terminal 6 and the third switch terminal 7 without distortion. The present invention achieves a durable switch function under repeated use.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulative housing defining a card receiving room;

a plurality of signal terminals received in the insulative housing;

an ejector assembled to a side of the insulative housing;

a first switch terminal retained on the ejector, urged by the ejector and slidable together with the ejector, the first switch terminal comprising a first arm, a second arm, and a connecting arm connecting with the first arm and the second arm;

a second switch terminal comprising a first contacting pad extending planar with respect to the insulative housing; and a third switch terminal comprising a second contacting pad extending planar with respect to the insulative housing and parallel with the first contacting pad, the first and second contacting pads establishing an electrical connection through the first switch terminal in response to a slidable movement of the ejector.

2. The card connector as described in claim 1, wherein the first arm keeps contacting with the second switch terminal during the movement of the ejector.

3. The card connector as described in claim 2, wherein the third switch terminal defines at least one cutout on the second contacting pad and the second arm contacts with the third switch except the time when the second arm move to the at least one cutout.

4. The card connector as described in claim 2, wherein the insulative housing defines a receiving cavity communicating with the card receiving room, and the ejector comprises a slider sliding in the receiving cavity and a transverse arm extending into the card receiving room.

5. The card connector as described in claim 4, wherein the connecting arm of the first switch terminal defines a hole and the slider comprises a base forming a pole protruding into the hole to secure the first switch terminal with the slider.

6. The card connector as described in claim 1, wherein the first contacting pad of the second switch terminal defines at least one cutout and the second contacting pad of the third switch terminal defines the same cutouts as the first contacting pad.

7. The card connector as described in claim 1, wherein the second switch terminal and the third switch terminal each further comprises a connecting pad extending from the contacting pad and a soldering pad extending along a same side as the contacting pad with respect to the connecting pad.

8. The card connector as described in claim 7, wherein the second switch terminal surrounds the third switch terminal.

9. The card connector as described in claim 7, wherein the signal terminals comprise a group of first terminals and a group of second terminals, each second terminal having a larger length than the first terminal.

10. The card connector as described in claim 9, wherein each signal terminal comprises a contacting portion extending toward the card receiving room, a rear portion extending out of the insulative housing.

11. The card connector as described in claim 10, wherein the contacting portions of the second terminals are aligned in a row and the contacting portions of the first terminals are arranged in the other row.

12. The card connector as described in claim 1, wherein the connecting arm is retained by the ejector and the first arm and the second arm double-tracked, curvedly extend from the connecting arm and respectively towards the second switch terminal and the third switch terminal.

13. A card connector with switch function for use with an electronic card, comprising:

an insulative housing defining a card receiving space;

a plurality of signal contacts disposed in the housing with contacting an ejector mechanism including a slider moveable relative to the housing in a front-to-back direction between an outer position where the card is fully ejected and an inner position where the card is properly received in the card receiving space and mated with the signal contacts, said ejector mechanism further including a heart-shaped slot and a pivotal pin member to regulate movement of the slider between the inner position and the outer position;

a switch unit including a moveable switch terminal and at least one immoveable switch terminal, said moveable switch terminal moveable along with the slider and between opposite outer and inner locations, said at least one immoveable switch terminal located around a moving path of said moveable switch terminal;

all said signal contacts and said at least one immoveable switch terminal being configured to be adapted to be mounted to a printed circuit board except said moveable switch terminal, wherein during insertion of the electronic card to push the slider, said signal contacts are in an "OFF" status when said slider is located at the outer position while shifting to an "ON" status when said slider is moved from the outer position toward the inner position with a pre-determined distance until terminating at the inner position; synchronously said switch unit experiences a switch cycle when said moveable switch terminal is cycled between the outer location and the inner location; wherein the moveable switch terminal defines a first position, a second position and a third position in sequence along said front-to-back direction relative to the housing under condition that said second position is located between said first position and said third position, and said switch unit is in a same status when said moveable switch terminal is located at the first position and the third position while being in an opposite status when said moveable switch terminal is located at the second position.

14. The card connector as claimed in claim 13, wherein said switch unit is in an "ON" status when the moveable switch terminal is located at the first position and the third position while is in an "OFF" status when the moveable switch terminal is located at the second position.

15. The card connector as claimed in claim 14, wherein said "ON"/"OFF" status results from mechanical and electrical engagement/disengagement between the moveable switch terminal and said at least one immoveable switch terminal.

16. The card connector as claimed in claim 15, wherein said switch unit further includes another immoveable switch terminal which are constantly engaged with the moveable switch terminal.

17. The card connector as claimed in claim 16, wherein the moveable switch terminal comprises a first arm, a second arm, and a connecting arm connecting with the first arm and the second arm, the connecting arm is retained by the slider, and the first arm and the second arm double-tracked, curvedly extend from the connecting arm respectively towards the two immoveable switch terminals.

18. A card connector with switch function for use with an electronic card, comprising:

an insulative housing defining a card receiving space;

a plurality of signal contacts disposed in the housing with contacting sections extending into the card receiving space;

an ejector mechanism including a slider moveable relative to the housing in a front-to-back direction between an outer position where the card is fully ejected and an inner position where the card is properly received in the card receiving space and mated with the signal contacts, said ejector mechanism further including a heart-shaped slot and a pivotal pin member to regulate movement of the slider between the inner position and the outer position;

a switch unit including a moveable switch terminal and at least one immoveable switch terminal, said moveable switch terminal moveable along with the slider and between opposite outer and inner locations, said at least one immoveable switch terminal located around a moving path of said moveable switch terminal;

all said signal contacts and said at least one immoveable switch terminal being configured to be adapted to be mounted to a printed circuit board except said moveable switch terminal, wherein during insertion of the electronic card to push the slider, said signal contacts are in an "OFF" status when said slider is located at the outer position while shifting to an "ON" status when said slider is moved from the outer position toward the inner position with a pre-determined distance until terminating at the inner position; synchronously said switch unit experiences a switch cycle when said moveable switch terminal is cycled between the outer location and the inner location; wherein at least one of the immoveable switch terminal and the movable switch terminal is deflectable when the moveable switch terminal moves along the immoveable switch terminal, and said switch unit experiences two shifts when the slider moves along said front-to-back direction during insertion of the card into the housing.

19. The card connector as claimed in claim 18, wherein when no card is inserted, said moveable switch terminal is located at a first position and said switch unit is in an "ON" status; when the card is mated with the connector, the moveable switch terminal is located at a second position and said switch unit is in an "OFF" status.

20. The card connector as claimed in claim 19, wherein one of said moveable switch terminal and said immoveable switch terminal defines a cutout to result in said "OFF" status.

* * * * *